US008286292B1

(12) United States Patent
Jacobson

(10) Patent No.: US 8,286,292 B1
(45) Date of Patent: Oct. 16, 2012

(54) RUG CLEANING SYSTEM

(76) Inventor: Roy Carl Jacobson, Bismarck, ND (US)

( * ) Notice: Subject to any disclaimer, the term of this patent is extended or adjusted under 35 U.S.C. 154(b) by 548 days.

(21) Appl. No.: 12/551,049

(22) Filed: Aug. 31, 2009

(51) Int. Cl.
*A47L 11/00* (2006.01)

(52) U.S. Cl. ..... 15/40; 15/77; 15/88.3

(58) Field of Classification Search ..... 15/21.1, 15/40, 77, 88.2, 88.3
See application file for complete search history.

(56) References Cited

U.S. PATENT DOCUMENTS 1,256,173 A 2/1918 Shampay
1,422,445 A 7/1922 Jones et al.
1,586,420 A * 5/1926 Friedman ..... 69/27
1,885,464 A * 11/1932 Miller ..... 15/302
1,986,947 A 1/1935 Stride
2,442,524 A * 6/1948 Witt ..... 15/89
2,657,045 A 10/1953 Wilson et al.
2,787,153 A 4/1957 Ketchum et al.
2,915,889 A 12/1959 Ethridge
3,304,566 A * 2/1967 Doerschlag ..... 15/77
3,772,732 A 11/1973 Gilmore
4,226,641 A 10/1980 Bode, Sr. et al.
4,368,627 A 1/1983 Bode, Sr. et al.
5,647,084 A * 7/1997 Still et al. ..... 15/104.92

* cited by examiner

*Primary Examiner* — Todd Manahan
*Assistant Examiner* — Brianne Kalach
(74) *Attorney, Agent, or Firm* — Neustel Law Offices

(57) ABSTRACT

A rug cleaning system for efficiently cleaning a rug without the need for bending over to reach the rug or being subjected to loose dust and debris. The rug cleaning system generally includes a housing having an entrance opening and an exit opening, with a passageway connecting the openings. A first roller is positioned on one side of the passageway at its upper portion with a second roller is positioned on the other side opposite the first roller. A cleaning brush is positioned beneath the second roller. As a rug is inserted into the entrance opening, it is sandwiched between the rollers and forced down through the passageway past the cleaning brush. The cleaning brush removes any debris from the rug and transfers the debris to a debris storage member through use of transfer members and a vacuum. The cleaned rug then exits the exit opening.

11 Claims, 8 Drawing Sheets

RUG CLEANING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a rug cleaners and more specifically it relates to a rug cleaning system for efficiently cleaning a rug without the need for bending over to reach the rug or being subjected to loose dust and debris.

2. Description of the Related Art

Any discussion of the related art throughout the specification should in no way be considered as an admission that such related art is widely known or forms part of common general knowledge in the field.

Rug cleaners have been in use for years. Rugs are often cleaned through use of a standard upright vacuum cleaner. When cleaning rugs with a standard upright vacuum cleaner, the vacuum cleaner will often get caught on bristles or other structures on the rug. It can also be burdensome on the back of the individual operating the upright vacuum cleaner.

Handheld vacuum cleaners have also been utilized by individuals to clean rugs. However, the use of such handheld cleaners requires that the individual operating the handheld device get on his or her hands and knees for an extended period of time. Further, the compactness of the handheld cleaner requires a large amount of time to properly clean a larger rug. This lengthy duration on one's hands and knees can be extremely painful for some individuals.

Additionally, previous rug cleaning methods have included taking the rug outdoors and shaking it vigorously until dust and debris has been largely cleared. Such a method is largely ineffective at removing smaller dust and debris and can often result in the individual inhaling unpleasant substances.

Because of the inherent problems with the related art, there is a need for a new and improved rug cleaning system for efficiently cleaning a rug without the need for bending over to reach the rug or being subjected to loose dust and debris.

BRIEF SUMMARY OF THE INVENTION

A device for efficiently cleaning a rug without the need for bending over to reach the rug or being subjected to loose dust and debris. The invention generally relates to a rug cleaner which includes a housing having an entrance opening and an exit opening, with a passageway connecting the openings. A first roller is positioned on one side of the passageway at its upper portion with a second roller is positioned on the other side opposite the first roller. A cleaning brush is positioned beneath the second roller. As a rug is inserted into the entrance opening, it is sandwiched between the rollers and forced down through the passageway past the cleaning brush. The cleaning brush removes any debris from the rug and transfers the debris to a debris storage member through use of transfer members and a vacuum. The cleaned rug then exits the exit opening.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIG. 5 is a side cutaway view of the present invention with a rug passing there through.

DETAILED DESCRIPTION OF THE INVENTION

Figure 1:
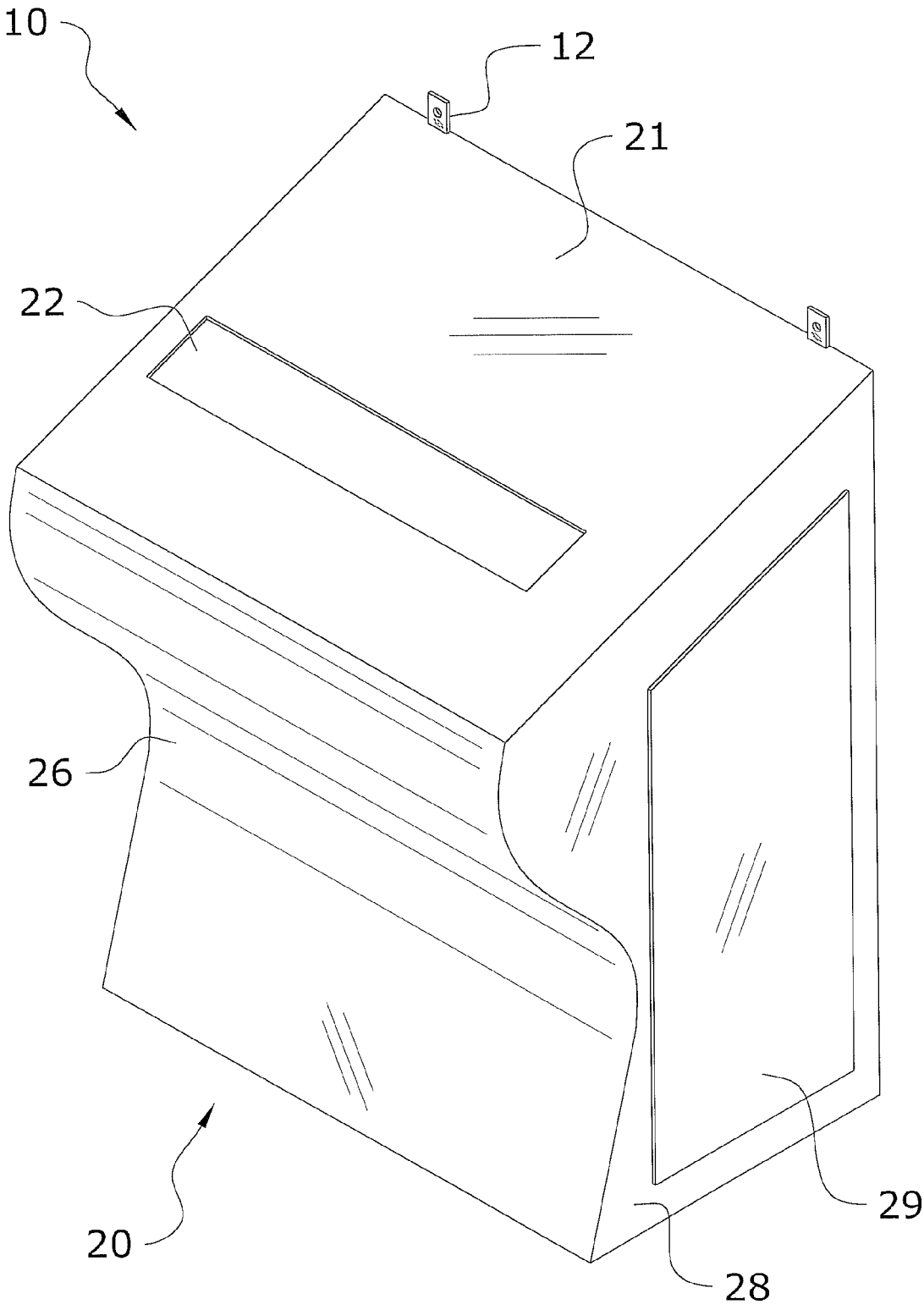
FIG. 1 is an upper perspective view of the present invention.

A. Overview.

Turning now descriptively to the drawings, in which similar reference characters denote similar elements throughout the several views, FIGS. 1 through 8 illustrate a rug cleaning system 10, which comprises a housing 20 having an entrance opening 22 and an exit opening 24, with a passageway 30 connecting the openings 22, 24. A first roller 40 is positioned on one side 34 of the passageway 30 at its upper portion with a second roller 50 is positioned on the other side 35 opposite the first roller 40. A cleaning brush 60 is positioned beneath the second roller 50. As a rug 14 is inserted into the entrance opening 22, it is sandwiched between the rollers 40, 50 and forced down through the passageway 30 past the cleaning brush 60. The cleaning brush 60 removes any debris 18 from the rug and transfers the debris 18 to a debris storage member 68 through use of transfer members 65, 66 and a vacuum 67. The cleaned rug 14 then exits the exit opening.

B. Housing.

The present invention will generally include a housing 20 for storing the various parts which comprise the rug cleaning system 10. However, it is appreciated that in some embodiments a housing 20 may not be included, instead utilizing solely a frame. The housing 20 may be comprised of various shapes and sizes, and it is appreciated that larger sized housings 20 may be utilized to accommodate large rugs 14, whereas smaller sized housings 20 may be utilized to accommodate smaller rugs 14. Although a specific shape is illustrated throughout the figures, it is appreciated that other shapes may be utilized for the housing 20 so long as all of the components of the rug cleaning system 10 may be operable therein and the housing is capable of being fixedly mounted on a wall. The housing 20 may be comprised of various materials including plastics and metals, though it is preferable that the housing 20 be comprised of a material which is somewhat lightweight so as to be simpler to lift and mount on a wall.

The housing 20 of the present invention will generally include an upper surface 21, lower surface 23, front surface 26, rear surface 27 and at least one side surface 28. The front surface 26 of the present invention may be comprised of various configurations, such as a curved configuration as illustrated in the figures or a flattened configuration. Utilizing a curved configuration as illustrated in FIG. 1 may assist with lifting and mounting the rug cleaning system 10, as well as creating a more aesthetically pleasing appearance for the housing 20.

Figure 8:
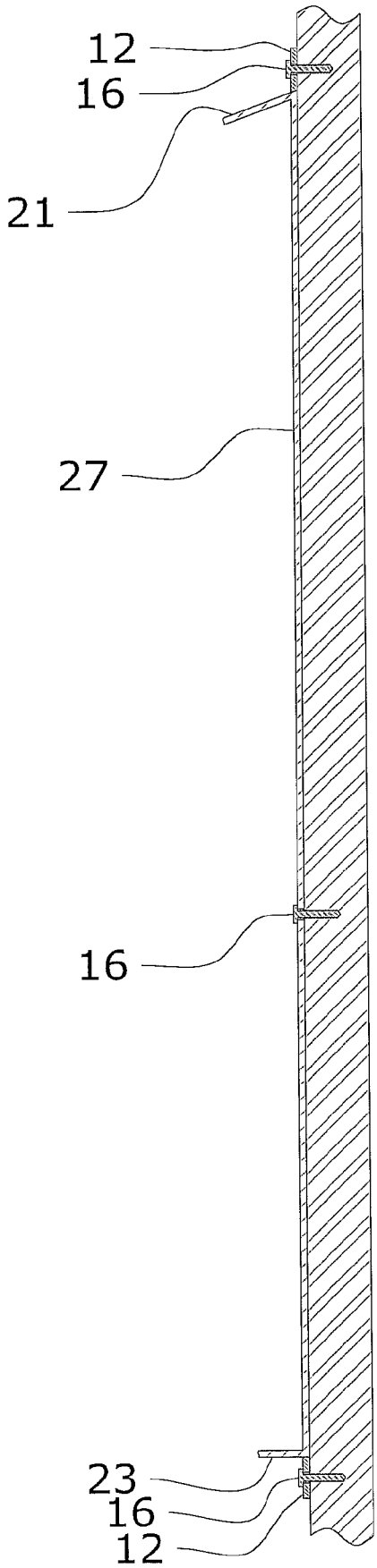
FIG. 8 is a side cutaway view of the rear surface of the housing of the present invention.

The rear surface 27 of the present invention will generally be comprised of a flat surface, though it is appreciated that various other configurations may be utilized to allow a more secure connection to the wall on which the present invention is mounted as well as to provide a more aesthetically pleasing appearance. In a preferred embodiment, the rear surface 27 of the housing will have at least one mounting bracket 12 fixedly attached thereto for mounting the housing 20 to a wall. As shown in FIG. 8, a preferred embodiment includes a first mounting bracket 12 at an upper portion of the rear surface 27 of the housing 20 and a second mounting bracket 12 positioned at a lower portion of the rear surface 27 of the housing 20.

It is further appreciated that at least one mounting aperture 16 may be included in the rear surface 27 of the housing 20 so as to provide an additional means for mounting the present invention to a wall. The mounting aperture 16 will generally be comprised of a keyed hole through which a bolt or screw may be inserted for additional mounting support.

The upper surface 21 of the housing 20 will generally be comprised of a substantially flat surface as shown in FIG. 1, though it is appreciated that the upper surface 21 may be slanted or not be substantially flat so long as there is space for an entrance opening 22 to be included thereon.

The entrance opening 22 will generally be comprised of an elongated opening in the upper surface 21 of the housing 20 through which a rug 14 may be passed for cleaning. In a preferred embodiment, the entrance opening 22 will be comprised of a substantially rectangular, elongated slot as illustrated in FIG. 1. However, it is appreciated that various other configurations may be utilized for the entrance opening 22, such as an elliptical or round opening, so long as a rug 14 may be easily fed there through without obstruction or difficulty. The entrance opening 22 may also be comprised of various sizes to accommodate variously sized rugs 14. It is also appreciated that the entrance opening 22 may be placed at various positions on the upper surface 21 of the housing 20, and should not be construed as being limited to the positioning illustrated in the figures.

Figure 2:
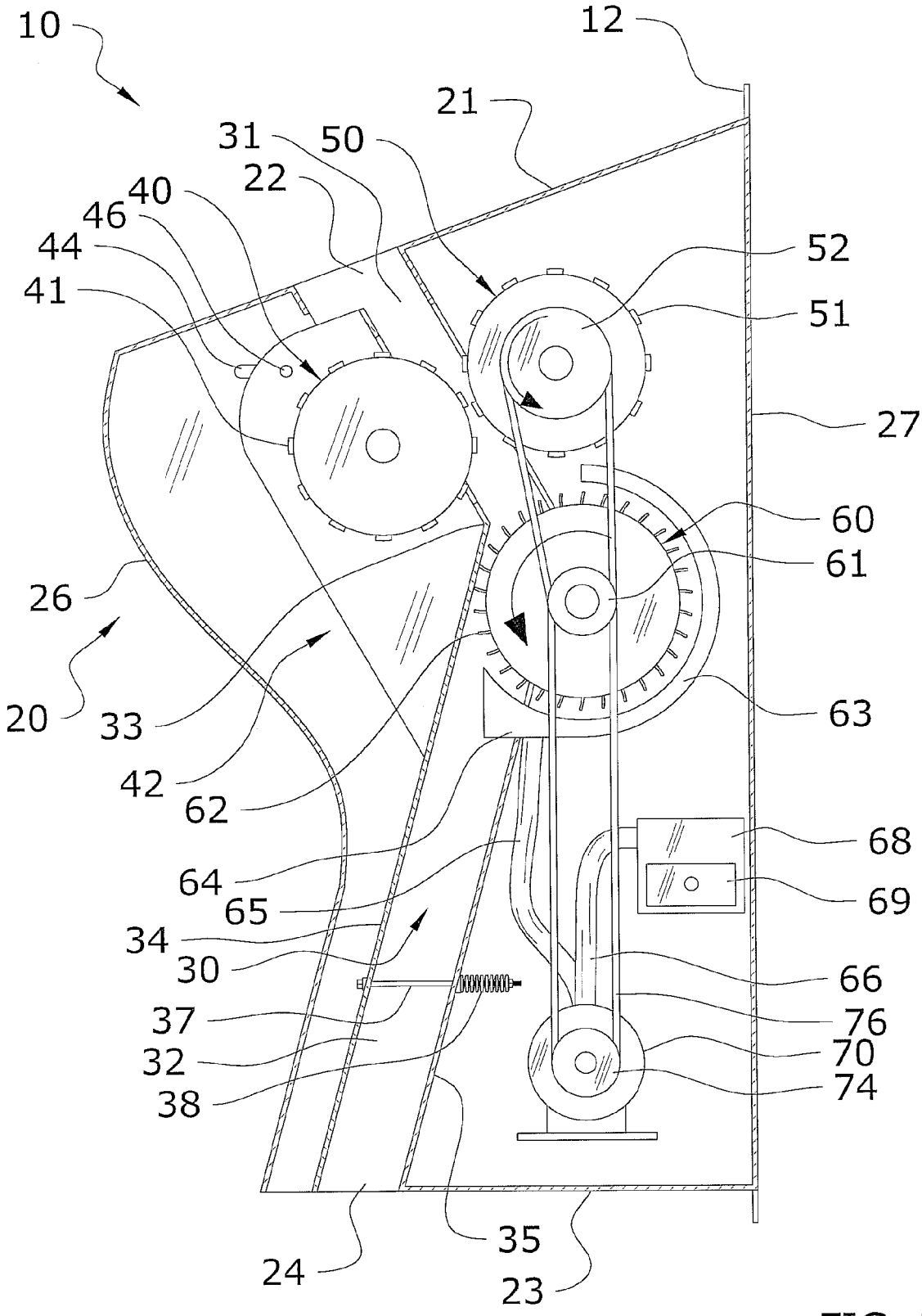
FIG. 2 is a side cutaway view of the present invention.

The lower surface 23 of the housing 20 will generally be comprised of a substantially flat surface as shown in FIG. 2, though it is appreciated that the lower surface 23 may be slanted or not be substantially flat so long as there is space for an exit opening 24 to be included thereon.

The exit opening 24 will generally be comprised of an elongated opening in the lower surface 23 of the housing 20 through which a rug 14 may exit the rug cleaning system 10. In a preferred embodiment, the exit opening 24 will be comprised of a substantially rectangular, elongated slot as illustrated in FIG. 2. However, it is appreciated that various other configurations may be utilized for the exit opening 24, such as an elliptical or round opening, so long as a rug 14 may easily exit there through without obstruction or difficulty. The exit opening 24 may also be comprised of various sizes to accommodate variously sized rugs 14. It is also appreciated that the exit opening 24 may be placed at various positions on the lower surface 23 of the housing 20, and should not be construed as being limited to the positioning illustrated in the figures. While it is preferable that the entrance opening 22 and exit opening 24 be of substantially the same size and shape as each other, it is also appreciated that they may differ in size and shape without affecting the overall operation of the present invention so long as a rug 14 may freely enter through the entrance opening 22 and exit through the exit opening 24 without obstruction or difficulty.

The side surface 28 of the housing 20 will generally be comprised of a flat surface as illustrated in FIG. 1. In a preferred embodiment, the housing 20 will include a pair of side surfaces 28. At least one of the side surfaces 28 of the housing 20 may include a side panel 29 which may be opened so that an individual may access the internal components of the present invention for cleaning or maintenance. The side panel 29 will preferably be comprised of a door which swings open and closed to expose the internal components of the housing 20, though it is appreciated that various other configurations may be utilized so long as they provide an easy way to access internal components when needed.

C. Passageway.

The present invention will generally include a passageway 30 extending from the entrance opening 22 of the housing 20 to the exit opening 24 of the housing 20. The passageway 30 will generally be comprised of an elongated pathway through which the rug 14 passes as it is cleaned by the present invention. The passageway 30 may be comprised of various cross-sections and sizes, and it is appreciated that differently sized passageways may be utilized on different embodiments of the present invention to accommodate variously shaped rugs 14.

Figure 6:
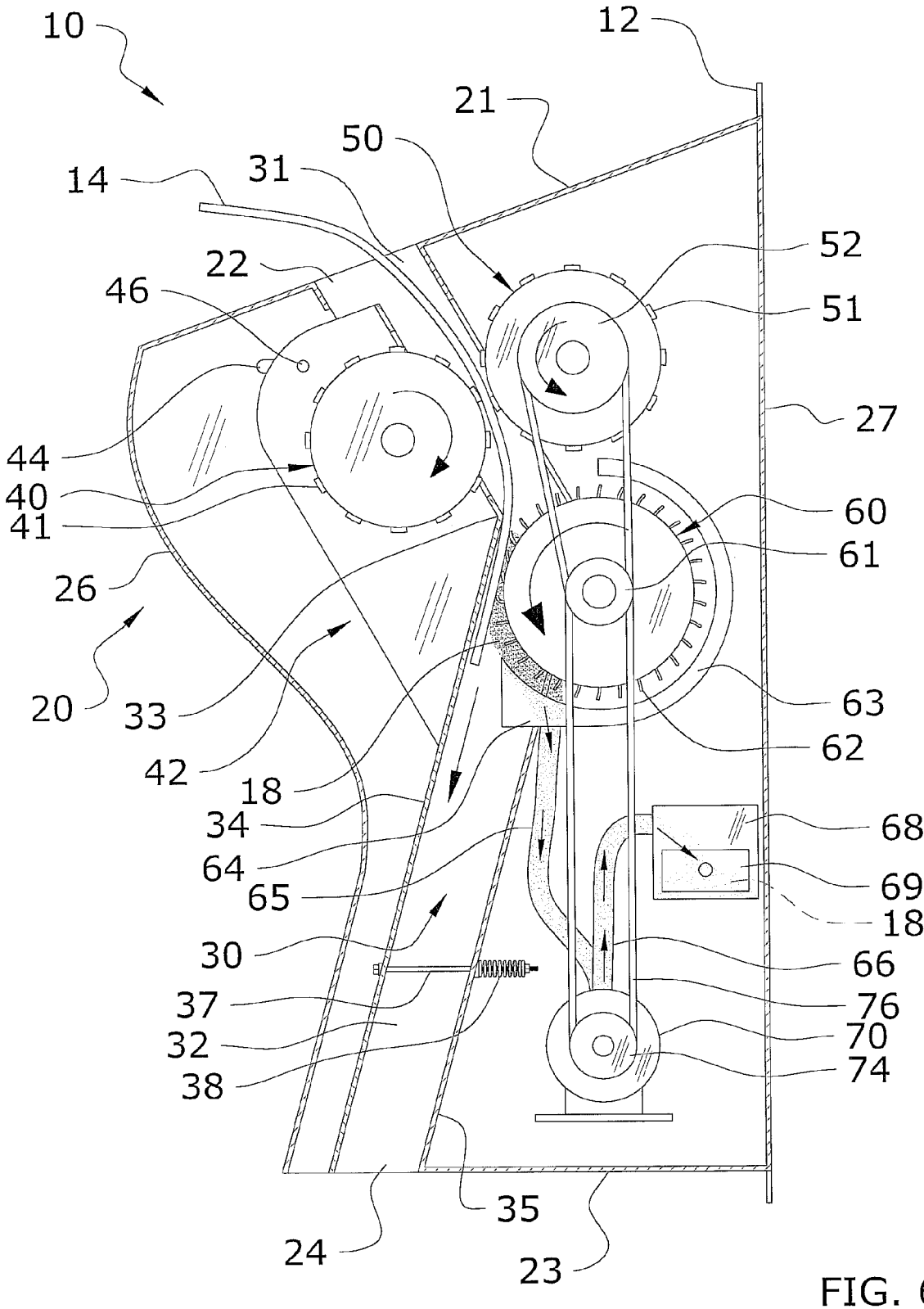
FIG. 6 is a side cutaway view of the present invention with a rug passing the cleaning brush.
Figure 7:
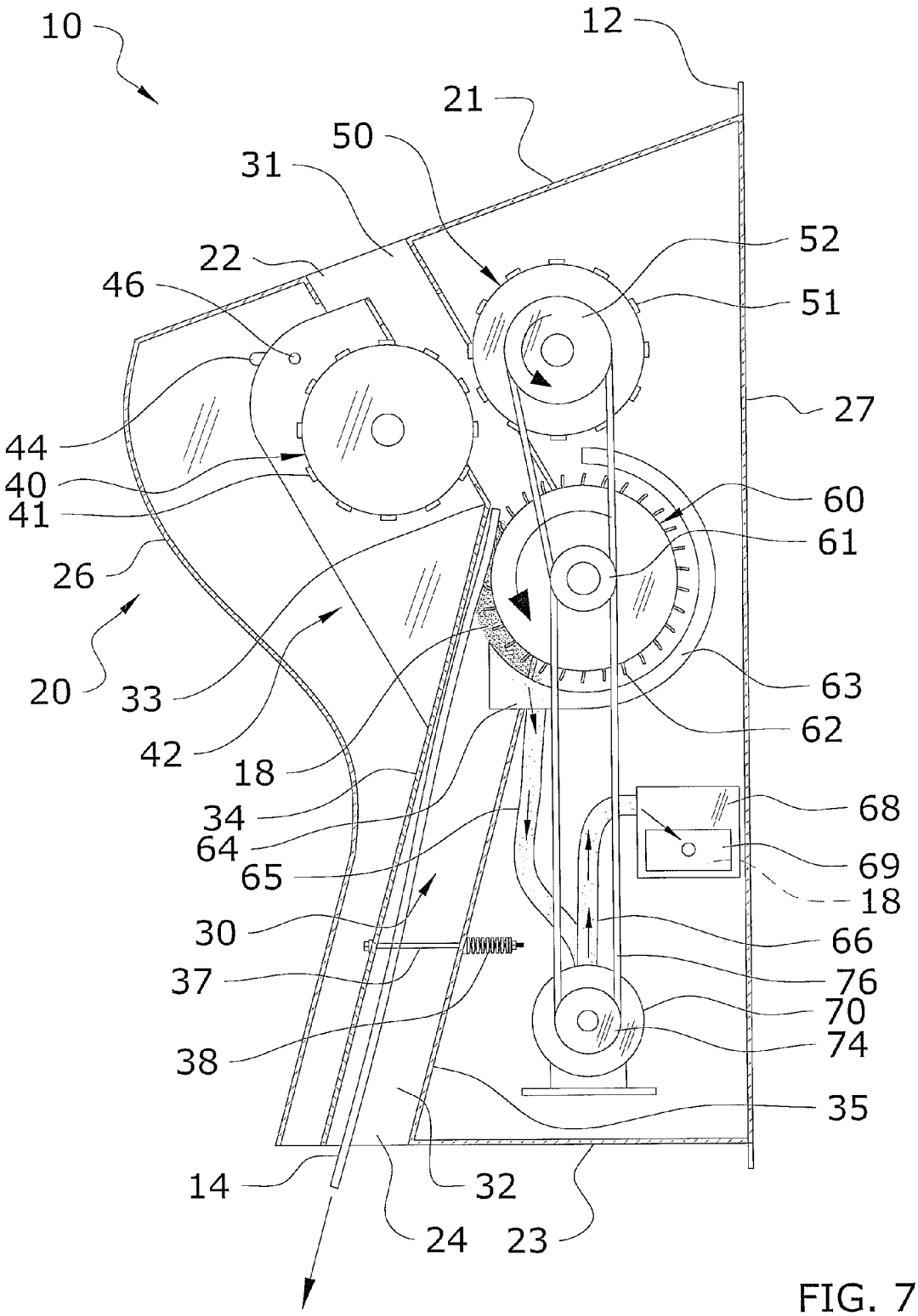
FIG. 7 is a side cutaway view of a rug exiting the present invention.

The passageway 30 of the present invention will generally include an upper portion 31 and a lower portion 32 as illustrated in FIG. 7, wherein the upper portion 31 and lower portion 32 are separated by a bend 33 in the passageway 30. Although the upper portion 31 and lower portion 32 are shown in the figures as being the same size as each other, it is appreciated that different sizes may be utilized. The bend 33 in the passageway 30 is utilized to provide maximum exposure of the cleaning brush 60 to the rug 14 as it passes through the rug cleaning system 10 as shown in FIG. 6. It is appreciated that the bend 33 may be placed at various locations in the passageway, and that the length of the upper portion 31 and lower portion 32 may vary accordingly in different embodiments.

Figure 5:
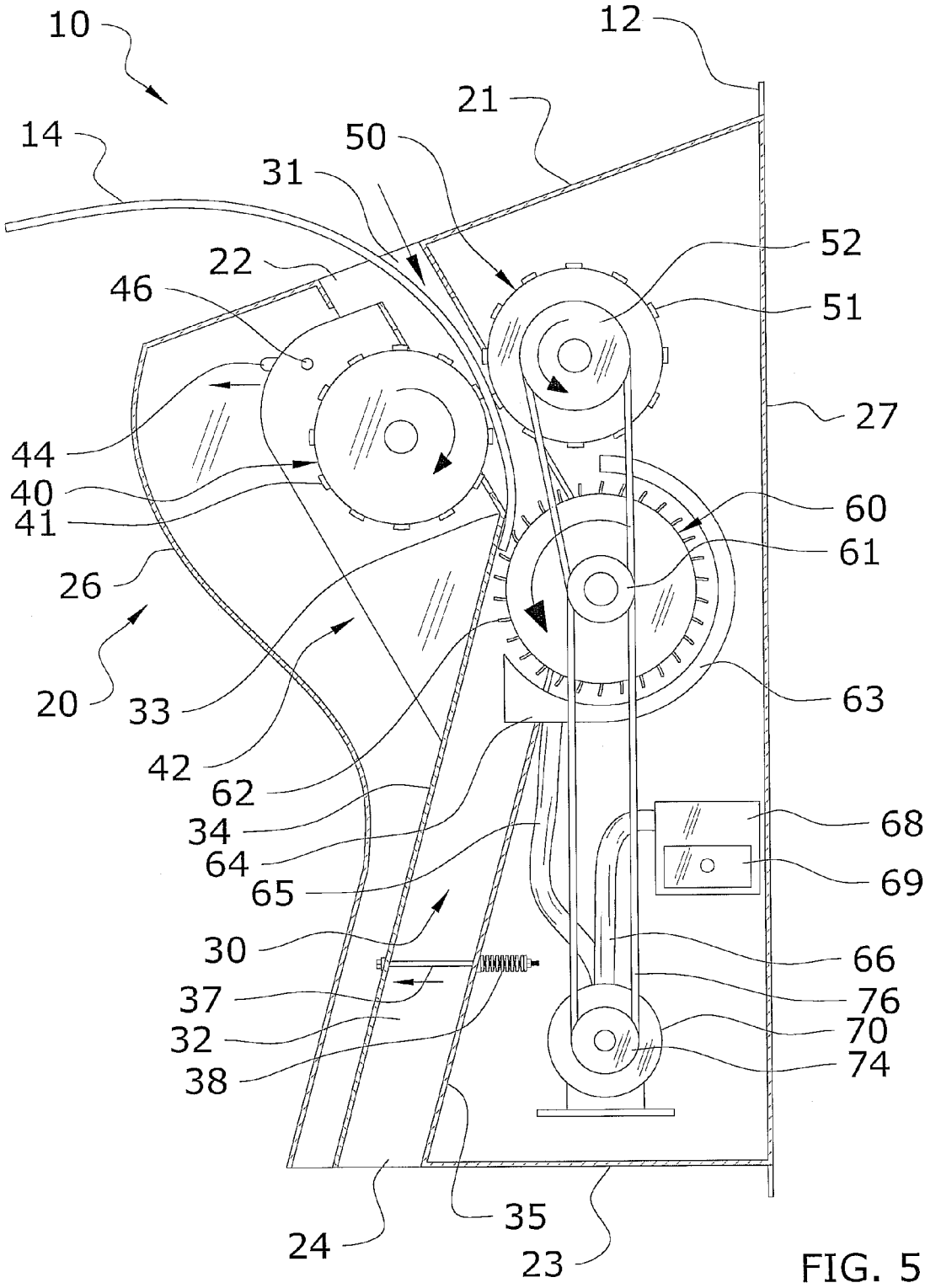

The passageway 30 will generally include a first side 34 and a second side 35 as shown in FIG. 5. The first side 34 of the passageway 30 is generally comprised of the surface of the passageway 30 which faces the front surface 26 of the housing 20. The second side 35 of the passageway 30 is generally comprised of the surface of the passageway 30 which faces the rear surface 27 of the housing 20.

Figure 4:
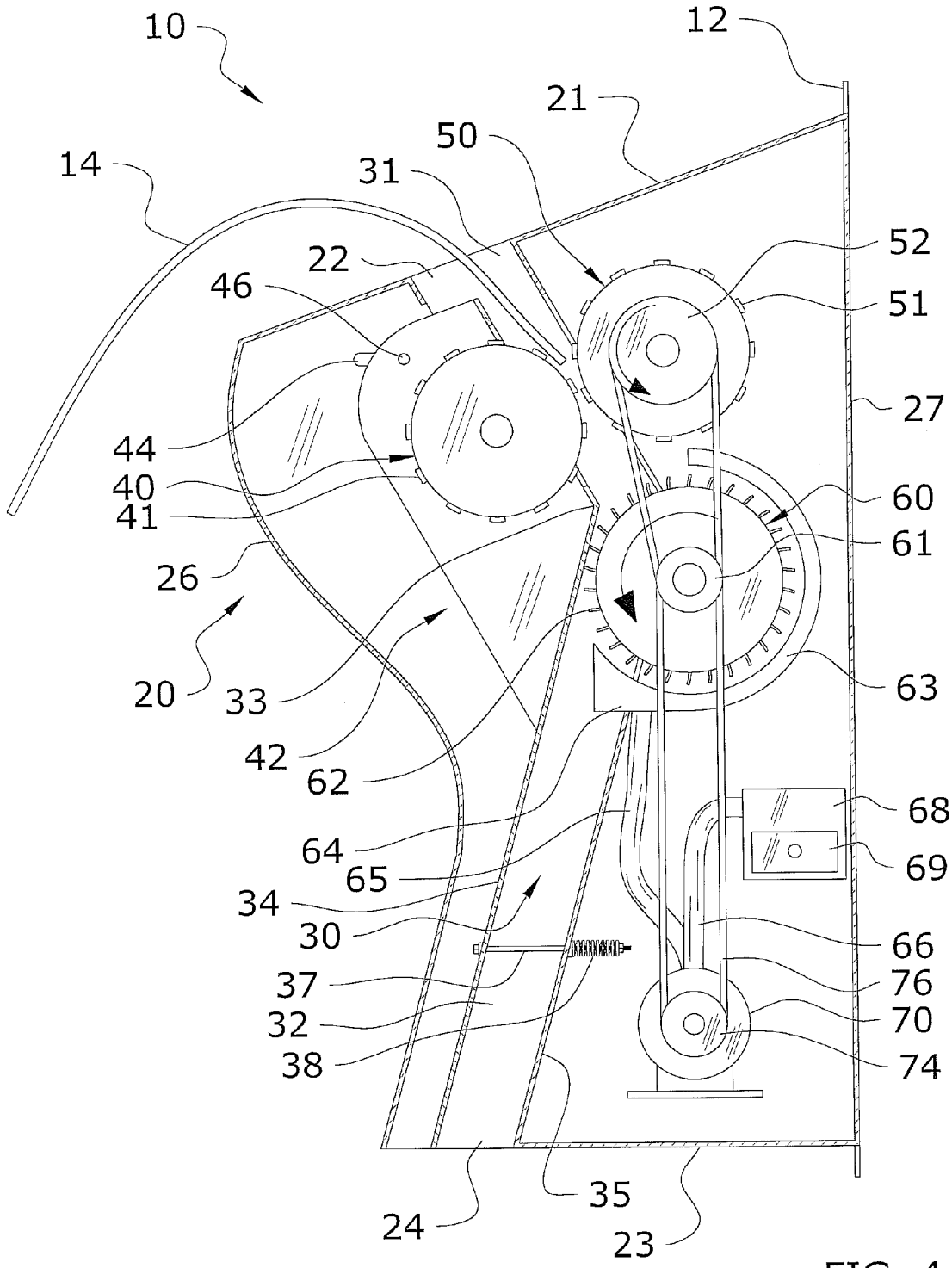
FIG. 4 is a side cutaway view of the present invention with a rug being inserted therein.

In some embodiments of the present invention, a passageway bolt 37 may be fixedly attached at one end to the first side 34 of the passageway 30 and at the other end to the second side 35 of the passageway 30 as shown in FIG. 4. In such an embodiment, the first side 34 of the passageway 30 is movably positioned within the housing 20 so that it may move away from and toward the second side 35 of the passageway 30, thus allowing the width of the passageway 30 to vary and allow a variety of differently sized rugs 14 to be cleaned in the same unit. In such an embodiment, the passageway bolt 37 includes a tension spring 38 positioned outside the second side 35 so as to allow the first side 34 to freely move toward and away from the second side 35 when needed. It is also notable that the passageway bolt 37 will generally be installed so as not to obstruct free passage of the rug 14 through the passageway 30 of the present invention.

D. First Roller.

The present invention will generally include a first roller 40 rotatably positioned to partially extend within the passageway 30 as illustrated in FIG. 2. The first roller 40 of the present invention will generally be comprised of an elongated, cylindrical configuration with a plurality of projections 41 extending from around its outer circumference. The projections 41 of the first roller 40 will generally act to compress the rug 14 as it passes through the passageway 30 and loosen any dirt and/or debris 18 thereon.

The projections 41 may be comprised of various materials, shapes and sizes, though it is preferable that the projections 41 be comprised of substantially rectangular, metal projections which extend radially out from the outer circumference of the first roller 40 as shown in FIG. 2. The number and spacing of the projections 41 may vary, so long as the first roller 40 is capable of properly compressing and feeding the rug 14 as it passes through the present invention.

The first roller 40 of the present invention will generally be mounted in its own assembly 42 as shown in FIG. 2 so as to be able to freely rotate. The assembly 42 will generally be comprised of a piece of material which may freely move into and out of the passageway 30 so as to allow the passageway 30 to vary in size to accommodate variously sized rugs 14. The assembly 42 will generally be movably attached to the housing 20 through use of a slotted hole 44 and pin 46 as shown in FIG. 2. When needed, the pin 46 moves horizontally through the slotted hole 44 to enlarge the width of the passageway 30 to ensure a tight press of the first roller 40 on any rug 14 passing there through.

The first roller 40 may be placed at various locations along the passageway 30, so long as at least a portion of the first roller 40 extends within the passageway 30 so as to firmly contact any rug 14 passing there through. As shown in FIG. 2, it is preferable that the first roller 40 be positioned in the upper portion 31 on the first side 34 of the passageway 30 so as to contact the rug 14 and start feeding it through the passageway 30 near its starting point at the upper surface 21 of the housing 20.

E. Second Roller.

The present invention will generally include a second roller 50 rotatably positioned to partially extend within the passageway 30 as illustrated in FIG. 2. The second roller 50 of the present invention will generally be comprised of an elongated, cylindrical configuration with a plurality of projections 51 extending from around its outer circumference. The projections 51 of the second roller 50 will generally act to compress the rug 14 as it passes through the passageway 30 and loosen any dirt and/or debris 18 thereon. The second roller 50 will also generally include a pulley 52 fixedly attached thereto for connection to a drive belt 76.

The projections 51 may be comprised of various materials, shapes and sizes, though it is preferable that the projections 51 be comprised of substantially rectangular, metal projections which extend radially out from the outer circumference of the second roller 50 as shown in FIG. 2. The number and spacing of the projections 51 may vary, so long as the second roller 50 is capable of properly compressing and feeding the rug 14 as it passes through the present invention.

The second roller 50 may be placed at various locations along the passageway 30, so long as at least a portion of the second roller 50 extends within the passageway 30 so as to firmly contact any rug 14 passing there through. As shown in FIG. 2, it is preferable that the second roller 50 be positioned in the upper portion 31 on the second side 35 of the passageway 30 so as to contact the rug 14 and start feeding it through the passageway 30 near its starting point at the upper surface 21 of the housing 20.

The second roller 50 will preferably act in conjunction with the first roller 40 to compress and feed the rug 14 as it enters the passageway 30 of the present invention. In a preferred embodiment, the second roller 50 will be rotatably attached at the second side 35 of the passageway 30 directly opposite the first roller 40. As a rug 14 passes through the upper portion 31 of the passageway 30, it will be compressed on either side by both the first roller 40 and second roller 50 as illustrated in FIG. 5. In such an embodiment, the first roller 40 will generally rotate in an opposite direction as the second roller 50. Preferably, the first roller 40 will rotate in a clockwise direction while the second roller 50 rotates in a counter-clockwise direction. Such a configuration allows the first and second rollers 40, 50 to act in conjunction with each other to feed the rug 14 through the passageway 30.

F. Roller Brush.

The present invention will generally include a cleaning brush 60 positioned to partially extend within the passageway 30 as shown in FIG. 2. The cleaning brush 60 of the present invention will generally be comprised of an elongated, cylindrical configuration with a plurality of brush members 62 extending from around its outer circumference. The cleaning brush 60 will preferably be rotatably positioned within the housing 20. The brush members 62 of the cleaning brush 60 will generally act to remove any dirt and/or debris 18 from the rug 14 as the cleaning brush 60 passes thereover. The cleaning brush 60 will also generally include a pulley 61 fixedly attached thereto for connection to a drive belt 76. The cleaning brush 60 will preferably rotate in a counter-clockwise direction similar to the second roller 50 so as to force the rug 14 downward through the passageway 30 as shown in FIG. 7.

The brush members 62 may be comprised of various materials, shapes and sizes, though it is preferable that the brush members 62 be comprised of clumped together brush bristles which extend radially out from the outer circumference of the cleaning brush 60 as shown in FIG. 2. The number and spacing of the brush members 62 may vary, so long as the cleaning brush 60 is capable of properly dislodging dirt and/or debris 18 from the rug 14 as it passes through the present invention. The bristles of the brush members 62 may be comprised of various materials, so long as the brush members 62 act to remove dirt and/or debris 18 from the rug 14 without damaging it.

The cleaning brush 60 may be placed at various locations along the passageway 30, so long as at least a portion of the cleaning brush 60 extends within the passageway 30 so as to allow the brush members 62 to firmly contact any rug 14 passing there through. As shown in FIG. 2, it is preferable that the cleaning brush 60 be positioned in the passageway 30 near its bend 33 directly below the second roller 50 so as to contact the rug 14 shortly after it passes through the space between the first roller 40 and second roller 50.

The cleaning brush 60 will generally be partially surrounded by a debris catch member 63 as shown in FIG. 2. The debris catch member 63 will generally be comprised of a semi-circular member which partially surrounds the cleaning brush 60 at the portions which do not come into contact with the rug 14 as it passes through the present invention. The debris catch member 63 acts to catch any dirt and/or debris 18 which is dislodged or removed from the rug 14 as it is brushed by the brush members 62 of the cleaning brush 60.

The debris catch member 63 will generally include a drain 64 which is fluidly connected to a first transfer member 65 as illustrated in FIG. 6. The first transfer member 65 may be comprised of various configurations, though it is preferable that tubing having a circular cross-section be utilized to allow free passage of dirt and/or debris 18 there through. However, it is appreciated that other cross-sections may be utilized.

Figure 3:
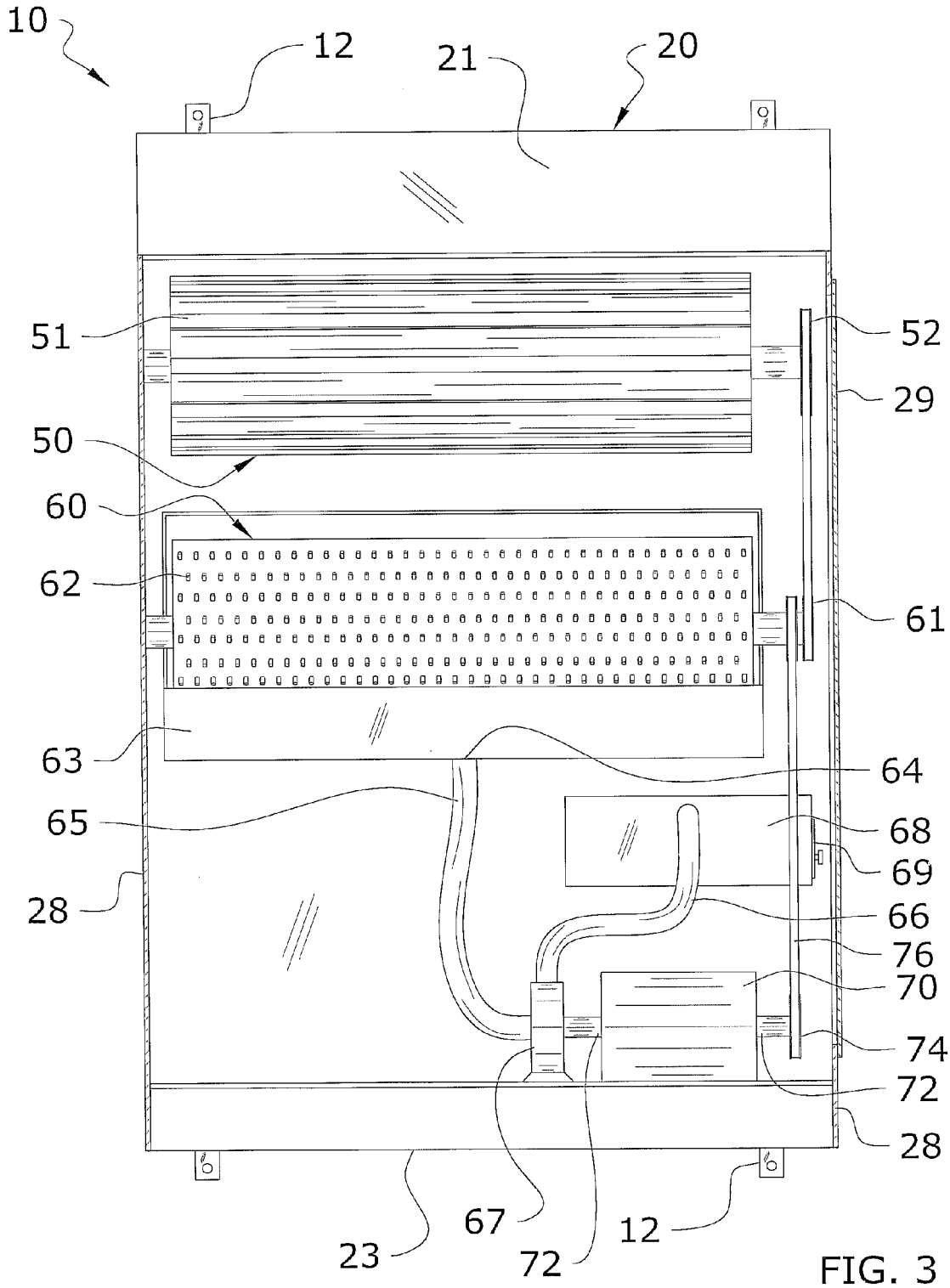
FIG. 3 is a front cutaway view of the present invention.

The first transfer member 65 will generally be fluidly connected to a vacuum member 67 as shown in FIG. 3. The vacuum member 67 will generally be comprised of a compact structure which creates downward suction in the first transfer member 65 so as to draw any dirt and/or debris 18 down through the drain 64 and through the first transfer member 65. The vacuum member 67 will generally be operable through use of a drive shaft 72 connected to a motor 70 as shown in FIG. 3.

The vacuum member 67 will also generally be fluidly connected to a second transfer member 66. The second transfer member 66 may be comprised of various configurations, though it is preferable that tubing having a circular cross-section be utilized to allow free passage of dirt and/or debris 18 there through. However, it is appreciated that other cross-sections may be utilized.

The second transfer member 66 will generally be connected at one end to the vacuum member 67 and at its second end to a debris storage member 68 as shown in FIG. 3. The vacuum member 67 will create the proper suction to force the dirt and/or debris 18 up through the second transfer member 66 and into the debris storage member 68.

The debris storage member 68 will generally be comprised of a tank or other structure which will hold any dirt and/or debris 18 which has been removed from any rug 14 passing through the present invention. Although the debris storage member 68 is shown as being comprised of a substantially rectangular configuration, other shapes may be utilized so long as they are capable of retaining a volume of dirt and/or debris 18. The debris storage member 68 will generally include an access door 69 to allow an individual to remove any dirt and/or debris 18 therefrom when it has reached capacity as shown in FIG. 7. The debris storage member 68 will generally be accessible through the side panel 29 on the side surface 28 of the housing 20.

G. Motor

The present invention will generally include a motor 70 for providing rotating power to the second roller 50 and cleaning brush 60. The motor 70 will also generally provide power to the vacuum member 67 of the present invention through use of a drive shaft 72. The motor 70 may be comprised of various configurations which act to provide the force and/or power required to operate the present invention. The drive shaft 72 will generally be comprised of a rotatable rod which is connected at one end to the motor 70 and at the other end to the vacuum member 67.

The motor 70 will also generally include a pulley 74 on which is mounted a drive belt 76. The drive belt 76 will generally be connected at one end to the pulley 74 of the motor 70 and at the other end to the pulley 52 of the second roller 50. The mid-section of the drive belt 76 will generally be rotatably connected to the pulley 61 of the cleaning brush 60.

H. Operation of Preferred Embodiment.

In use, a rug 14 is first inserted into the entrance opening 22 of the housing 20. The rug 14 will then be sandwiched in between the projections 41 of the first roller 40 and the projections 51 of the second roller 50. The first roller 40 and second roller 50 will act to force the rug 14 through the passageway 30 while at the same time compressing the rug 14 to assist with removal of debris 18.

After passing in between the first roller 40 and second roller 50, the rug 14 will pass the cleaning brush 60. The rug 14 will be sandwiched in between the cleaning brush 60 and second side 35 of the passageway 30 so as to allow the brush member 62 to dislodge any debris 18 present in the rug 14. The debris 18 will then be suctioned down the drain 64, into the first transfer member 65 and through the vacuum member 67. It will then be routed through the second transfer member 66 into the debris storage member 68. The rug 14 will pass through the rest of the passageway 30 and exit through the exit opening 24 on the lower surface 23 of the housing 20 in a cleaned state. Debris 18 may then be removed from the debris catch member 63 by accessing the interior of the housing 20 through the side panel 29 and opening the access door 69.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A rug cleaning system, comprising:

a housing including an entrance opening and an exit opening;

a passageway extending through said housing from said entrance opening to said exit opening;

a passageway bolt fixedly attached at a first end to a first side of a first surface forming a first side of said passageway and at a second end to a second surface forming a second side of said passageway, wherein said first side of said passageway is movably positioned with respect to said second side of said passageway for allowing the width of said passageway to vary, wherein said passageway bolt includes a tension spring;

a cleaning brush attached to said housing adjacent said passageway;

a motor mechanically connected to said cleaning brush to move said cleaning brush with respect to a rug being cleaned of debris; and a first roller rotatably connected to said housing adjacent a first side of said passageway, wherein a portion of said first roller extends within said passageway; and a second roller rotatably connected to said housing adjacent a second side of said passageway, wherein a portion of said second roller extends within said passageway, wherein said first roller and said second roller guide said rug towards said cleaning brush, wherein said first roller rotates in a first direction and said second roller rotates in a second direction, wherein said cleaning brush rotates in said second direction, wherein said first direction is comprised of a clockwise direction and said second direction is comprised of a counter-clockwise direction.

2. The rug cleaning system of claim 1, wherein said cleaning brush includes a plurality of brush members extending radially from its outer circumference.

3. The rug cleaning system of claim 1, wherein said housing includes a rear surface, wherein said rear surface of said housing includes at least one mounting bracket.

4. The rug cleaning system of claim 1, wherein said housing includes a side surface, wherein a side panel is positioned on said side surface to allow access to the interior of said housing.

5. The rug cleaning system of claim 1, wherein said passageway includes an upper portion and a lower portion, wherein said upper portion of said passageway is separated from said lower portion of said passageway by a bend.

6. The rug cleaning system of claim 5, wherein said cleaning brush is rotatably positioned adjacent said bend.

7. The rug cleaning system of claim 1, further comprising a debris storage member positioned beneath said cleaning brush.

8. The rug cleaning system of claim 7, wherein said debris storage member includes an access door.

9. The rug cleaning system of claim 3, wherein said rear surface of said housing includes at least one mounting aperture.

10. The rug cleaning system of claim 1, wherein said housing includes an upper surface and a lower surface, wherein said upper surface includes said entrance opening, wherein said lower surface includes said exit opening.

11. A rug cleaning system, comprising:

a housing including an upper surface, a lower surface and a rear surface, wherein said upper surface includes an entrance opening, wherein said lower surface includes an exit opening, wherein said rear surface includes at least one mounting bracket attached thereto, wherein said rear surface of said housing includes at least one mounting aperture;

wherein said housing includes a side surface, wherein a side panel is positioned on said side surface to allow access to the interior of said housing;

a passageway extending through said housing from said entrance opening to said exit opening, wherein said passageway includes a first side and a second side, wherein said passageway includes an upper portion and a lower portion, wherein said upper portion of said passageway is separated from said lower portion of said passageway by a bend;

a passageway bolt fixedly attached at a first end to a first side of a first surface forming a first side of said passageway and at a second end to a second surface forming a second side of said passageway, wherein said first side of said passageway is movably positioned with respect to said second side of said passageway for allowing the width of said passageway to vary, wherein said passageway bolt includes a tension spring;

a cleaning brush partially extended within said passageway so as to contact a rug passing through said passageway, wherein said cleaning brush includes a pulley, wherein said cleaning brush includes a plurality of brush members extending radially from its outer circumference, wherein said cleaning brush is rotatably positioned adjacent said bend;

a first roller partially extended within said passageway above said cleaning brush, wherein said first roller is rotatably positioned adjacent said first side of said passageway, wherein said first roller includes a plurality of projections extending radially from its outer circumference;

a second roller partially extended within said passageway above said roller member, wherein said second roller is rotatably positioned adjacent said second side of said passageway opposite of said first roller, wherein said second roller includes a plurality of projections extending radially from its outer circumference, wherein said second roller includes a pulley;

wherein said first roller rotates in a first direction and said second roller rotates in a second direction, wherein said cleaning brush rotates in said second direction, wherein said first direction is comprised of a clockwise direction and said second direction is comprised of a counter-clockwise direction;

a debris catch member at least partially surrounding said cleaning brush, wherein said debris catch member includes a drain, wherein said debris storage member includes an access door;

a first transfer member, wherein a first end of said first transfer member is fluidly connected to said drain and a second end of said first transfer member is fluidly connected to a vacuum member;

a second transfer member, wherein a first end of said second transfer member is fluidly connected to said vacuum member, wherein a second end of said second transfer member is fluidly connected to a debris storage member;

a motor positioned within said housing, wherein said motor includes a pulley and a drive belt, wherein said drive belt is positioned around said pulley of said motor, said pulley of said cleaning brush and said pulley of said second roller, wherein said motor includes a drive shaft, wherein said drive shaft is connected to said vacuum member.

* * * * *